United States Patent [19]

Montgomery

[11] Patent Number: 4,749,188

[45] Date of Patent: Jun. 7, 1988

[54] SAFETY WEIGHT BAR ASSEMBLY

[76] Inventor: Calvin W. Montgomery, 7 Baynard Cove Rd., Hilton Head, S.C. 29928

[21] Appl. No.: 56,780

[22] Filed: Jun. 2, 1987

[51] Int. Cl.[4] ..... A63B 13/00

[52] U.S. Cl. ..... 272/123; 272/143; 272/117

[58] Field of Search ..... 272/93, 117, 118, 122, 272/123, 143

[56] References Cited

U.S. PATENT DOCUMENTS

| | | | |
|---|---|---|---|
| 3,384,370 | 5/1968 | Bailey et al. | 272/123 |
| 3,414,261 | 12/1968 | Huebner | 272/117 |
| 3,904,198 | 9/1975 | Jones | 272/123 |
| 4,360,198 | 11/1982 | Waulters | 272/117 |
| 4,369,968 | 1/1983 | Price | 272/123 |
| 4,566,690 | 1/1986 | Schook | 272/123 |
| 4,618,142 | 10/1986 | Joseph, Jr. | 272/123 |
| 4,629,184 | 12/1986 | Selker | 272/123 |

*Primary Examiner*—Richard J. Apley
*Assistant Examiner*—J. Welsh
*Attorney, Agent, or Firm*—Fleit, Jacobson, Cohn & Price

[57] ABSTRACT

A weight bar assembly in which weight supporting elements at each of a main bar support a variable number of weights. The weights have a center of gravity which is laterally displaced to one side of the main bar. The main bar of the assembly is supported at a distance vertically above the ground at all times, either by a vertical connection bar or by the weights themselves. The weight bar assembly further includes handles connected to the main bar and including gripping portions which are laterally displaced to the same side of the main bar as the center of gravity of the weights.

8 Claims, 10 Drawing Sheets

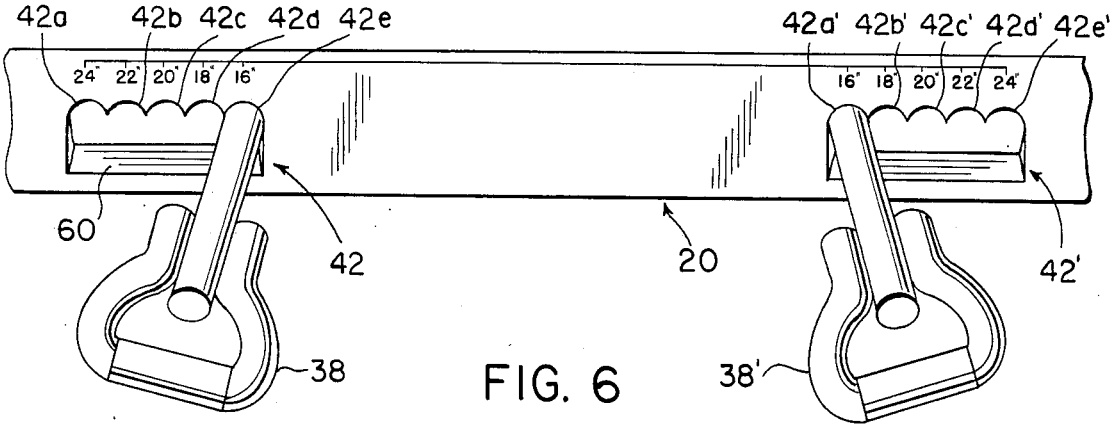
FIG. 6
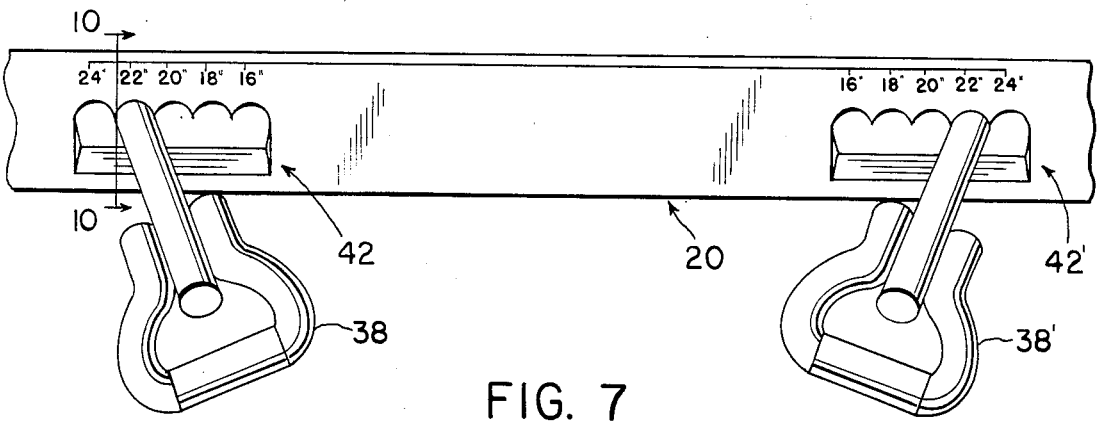
FIG. 7
FIG. 8
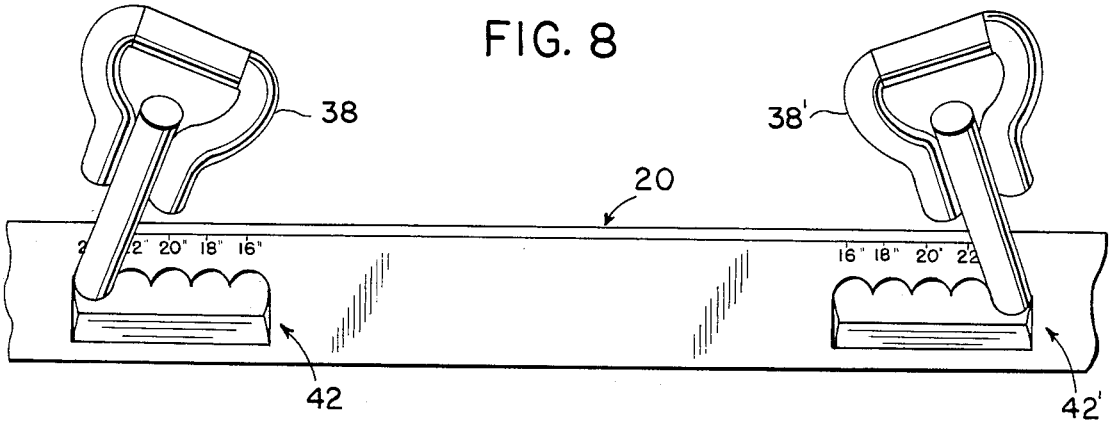
FIG. 9
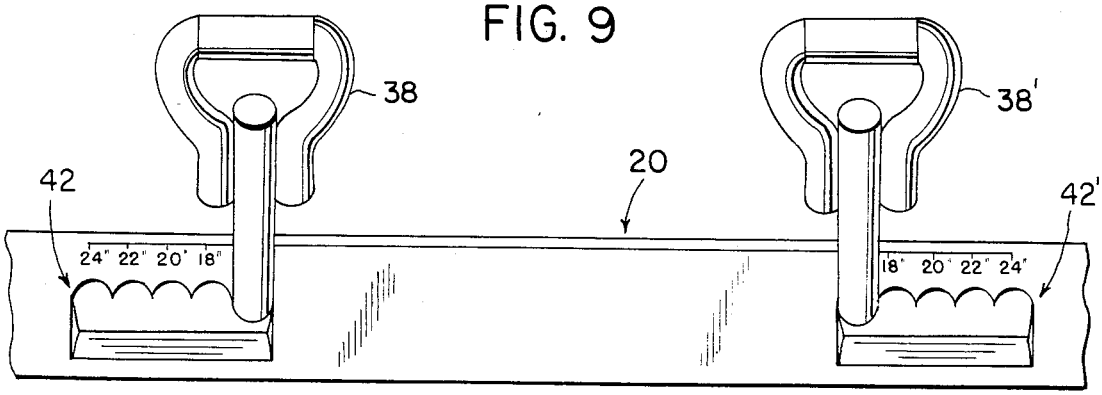

FIG. 14
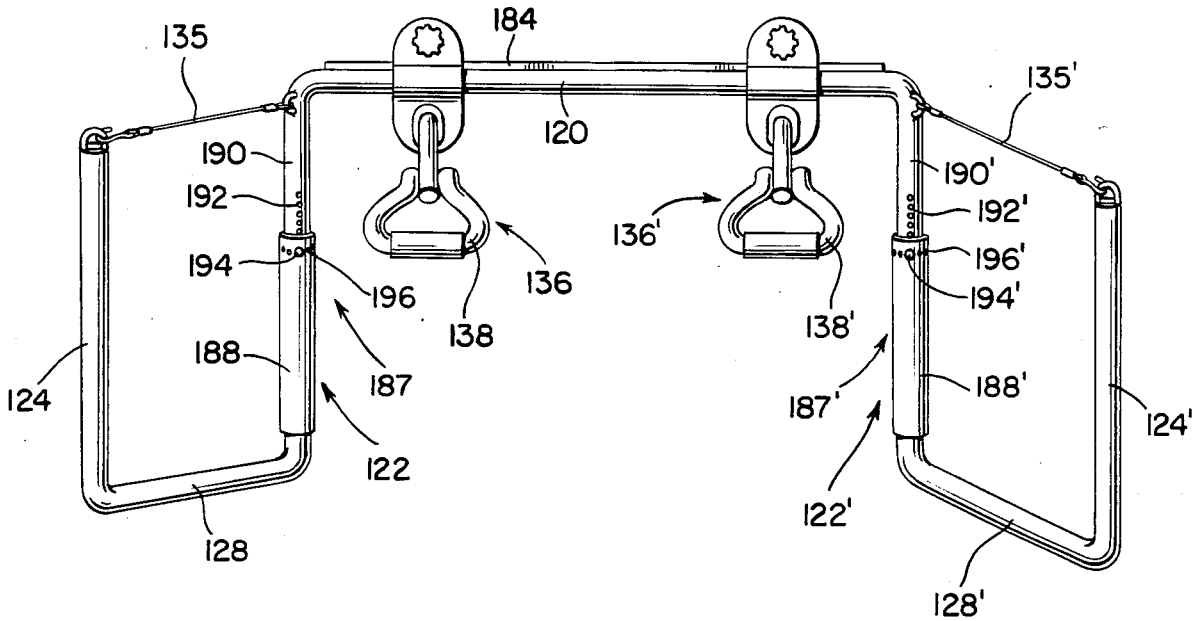
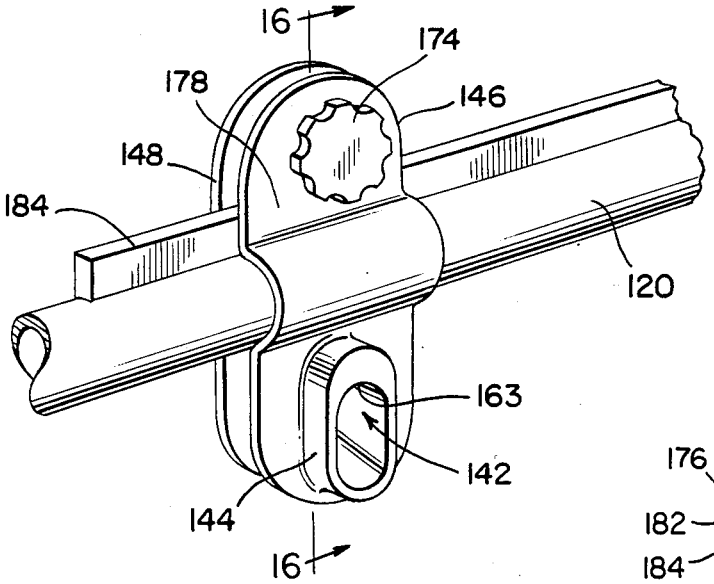
FIG. 15
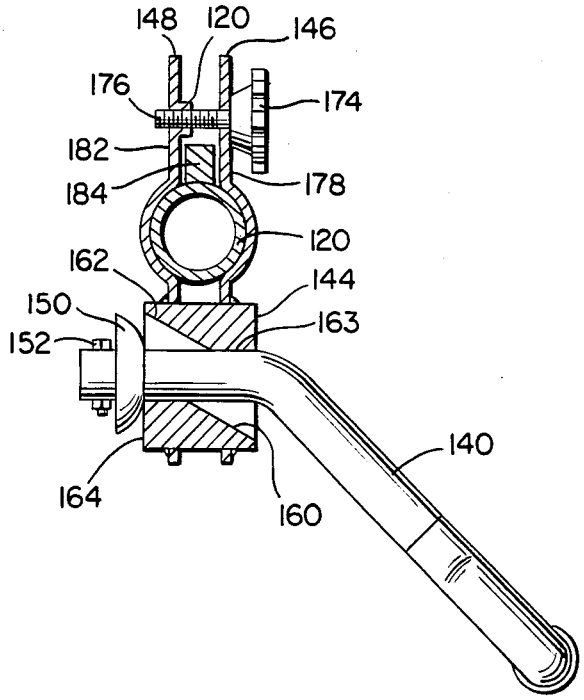
FIG. 16

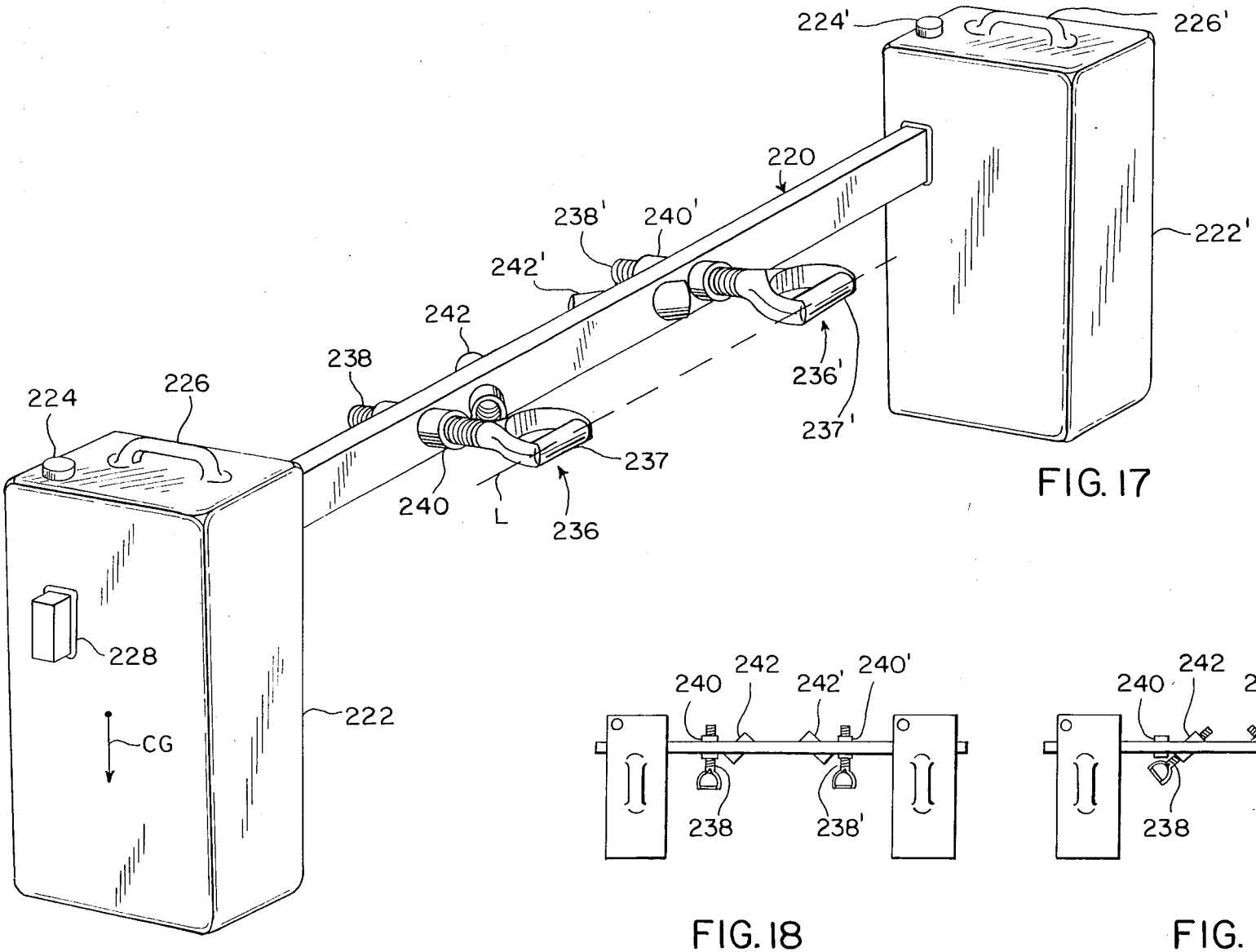
FIG. 17
FIG. 18
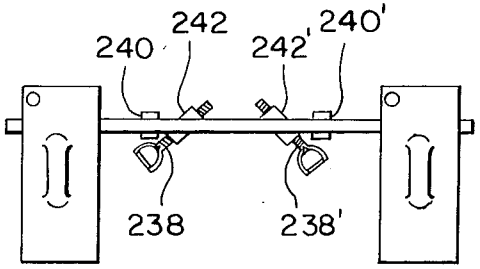
FIG. 19

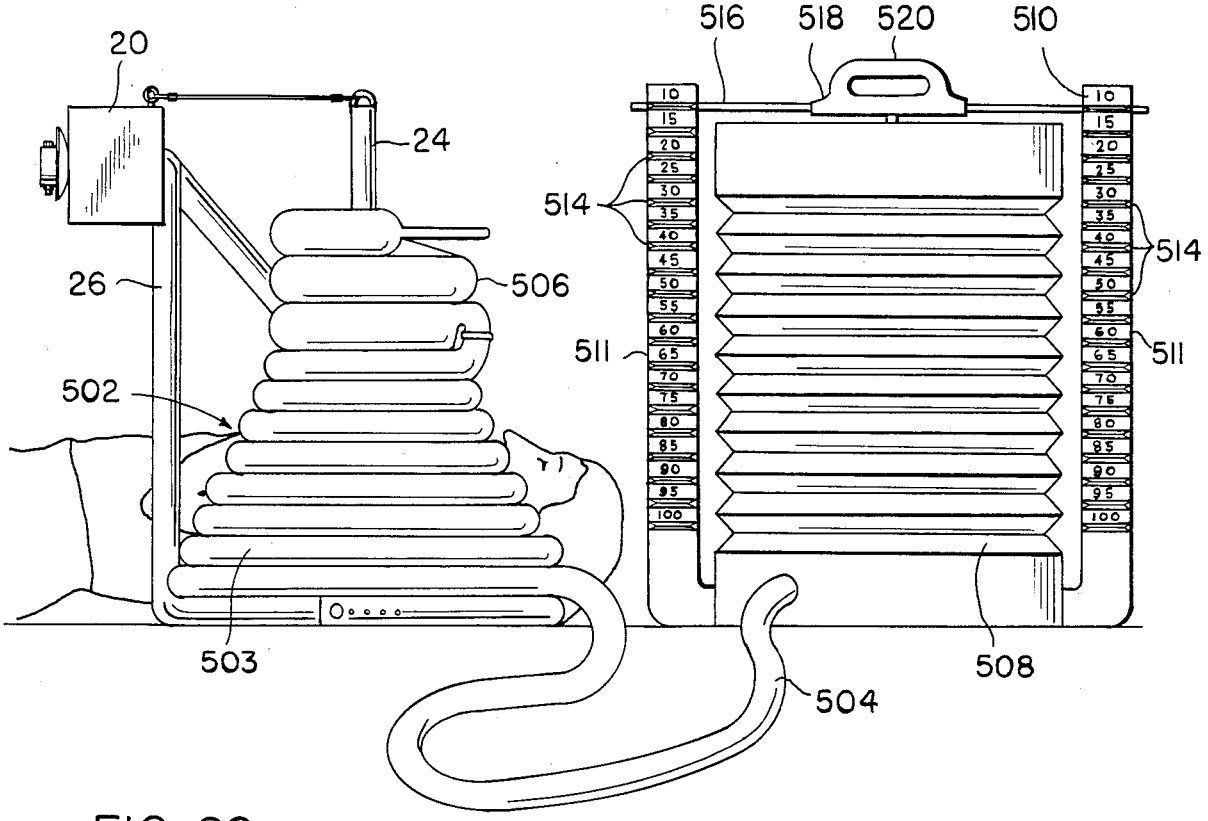
FIG. 26
FIG. 27
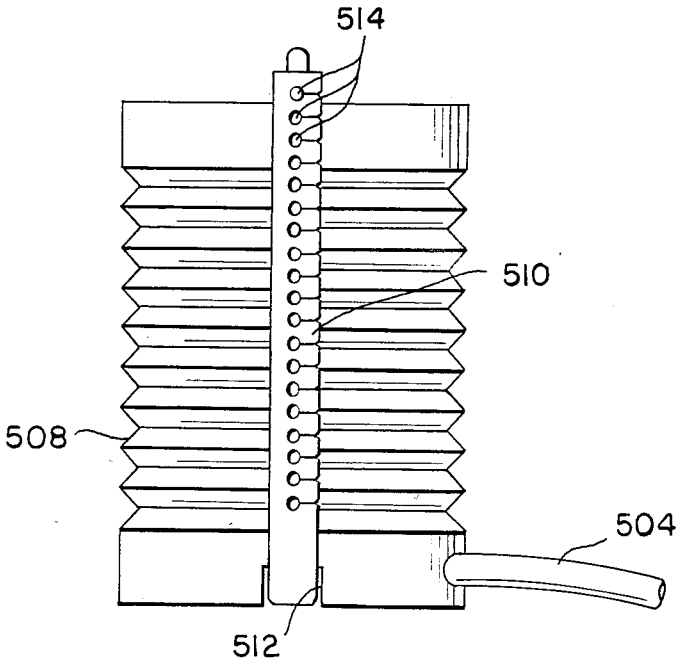

SAFETY WEIGHT BAR ASSEMBLY

BACKGROUND OF THE INVENTION

This invention relates to an improved weight lifting bar construction providing improved safety, adjustability and convenience to a weight lifter.

Standard weight bars, used in combination with weight benches, are potentially a cause of death or injury should a weight lifter lose control of or become unable to lift the weight bar during a press. When used in bench press exercises, the portion of a conventional weight bar between the hands of a weight lifter is directly in line with the weight lifter's neck, and injury to the lifter's neck is possible. Also, since the weights themselves are unable to contact the ground while a person is lifting the weights from a bench, the person must use his or her strength to replace the weight bar on hangers which are usually located at the upper portion of the weight bench.

U.S. Pat. No. 4,566,690 discloses horizontal chin-up pipe extending between a pair of upright pipes. By appropriately adjusting the length of the upright pipes, the arrangement can be used for bench pressing or squat exercising; however, the horizontal pipe is directly in line with the weights. During a lift, a weight lifter utilizing the arrangement disclosed in this patent is unable to align his or her body in a normal stance directly between the weights. Furthermore, it is necessary to use a weight bench with the arrangement disclosed in this patent when performing press type exercises.

U.S. Pat. No. 4,629,184 discloses a weight lifting apparatus including a frame with handles in alignment with weights.

SUMMARY OF THE INVENTION

This invention eliminates the possibility that the bar of the weight lifting assembly will come into contact with the body of a weight lifter during pressing exercises by including a spacing bar affixed to the main bar which supports the main bar at all times vertically above the ground. The weight lifting bar of the instant invention further includes weights having a center of gravity laterally displaced to one side of the main bar and handles with gripping portions laterally displaced to the same side of the main bar aligned with the center of gravity of the weight lifting assembly so that a weight lifter is able to balance the weight of the assembly in line with his or her normal body stance during curling exercises.

The handles may each be moved from side to side to any one of a variety of distances apart from one another along the main bar. Additionally, the handles may be oriented in either a setting above or below the main bar for different types of exercises.

The orientation of the gripping portions of the handles may also be adjusted relative to the main bar to allow wrists of a weight lifter to assume a natural angle throughout a particular lift.

The weights may also easily and efficiently be mounted on the main bar by passing a pin through aligned holes in each weight and the main bar to lock each weight to the main bar.

It is an object of this invention to provide a weight bar assembly comprising a lift bar having two ends and weight receiving bars located at each of the two ends of the lift bar and offset from one side of the lift bar for locating a center of gravity of the weights away from a longitudinal axis of the lift bar. The weight bar assembly further includes handles projecting from the lift bar toward the one side of the lift bar for locating a line of balance passing through the handles offset from the longitudinal axis of the lift bar and on the same side of the lift bar as the center of gravity of the weights.

It is a further object of this invention to provide a weight bar assembly comprising a main bar having a pair of ends, a weight supporting element located at each end of the main bar, the weight supporting elements supporting a variable number of weights having a center of gravity laterally displaced to one side of the main bar when mounted on the weights supporting elements. The weight supporting elements include spacers affixed to the main bar and supporting the main bar at a distance vertically above ground. The weight bar assembly further includes handles connected to the main bar and disposed centrally of the weight supporting elements, each handle including a gripping portion laterally displaced to the one side of the main bar and an angular shaft secured at one end to the gripping portion. Each angular shaft is received in a slot formed in the main bar and is movable to allow each handle to be oriented in a first position located above the main bar and a second position located below the main bar.

Other objects and features of the invention will be apparent from the following drawing figures and description of the preferred embodiments.

BRIEF DESCRIPTION OF THE DRAWINGS

FIGS. 6 and 7 illustrate the angular handle shafts of FIG. 1 at different distances apart and at different angular positions as the weight bar assembly is used in pressing exercises;

FIGS. 8 and 9 illustrate the angular handle shafts of FIG. 1 at different distances apart and different angular positions as the weight bar assembly is used in curling exercises;

FIG. 14 illustrates a weight bar assembly;

FIG. 15 illustrates the connection between the handles and the main bar of FIG. 14;

FIG. 16 is a partly sectional view of the connection illustrated in FIG. 15 as it appears when viewed in the direction of section line 16—16;

FIGS. 17–19 illustrate a weight bar assembly including handles movable inwardly and outwardly and at different angles with respect to the main bar;

FIGS. 26 and 27 illustrate a weight bar assembly used in conjunction with alternative weights.

DESCRIPTION OF THE PREFERRED EMBODIMENTS

The present invention will now be described with reference to the specific structure illustrated in FIGS. 1–27. Other equivalent structure clearly could be utilized by those skilled in the art.

Figure 1:
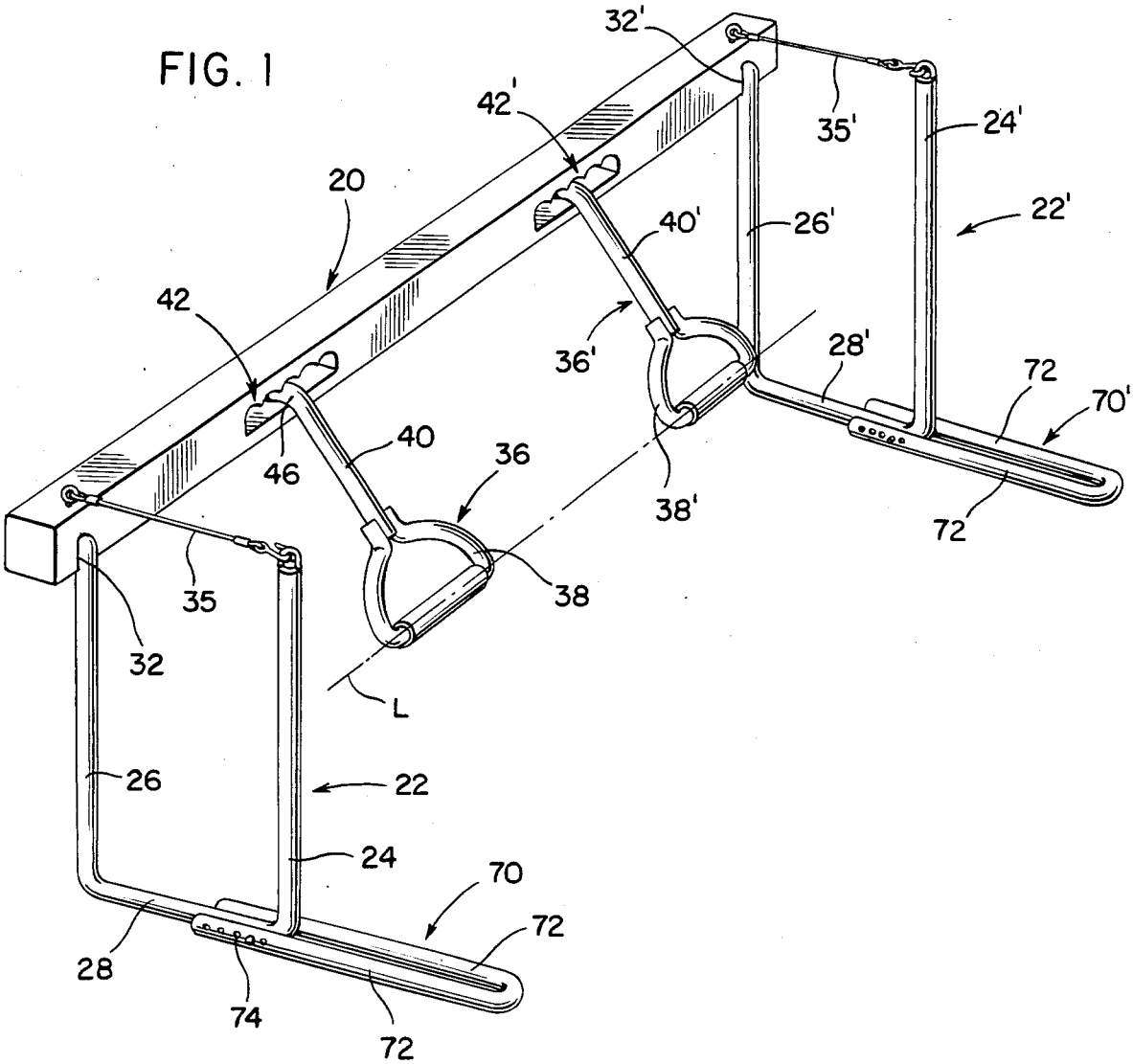
FIG. 1 illustrates a perspective view of a weight bar assembly of the instant invention.
Figure 2:
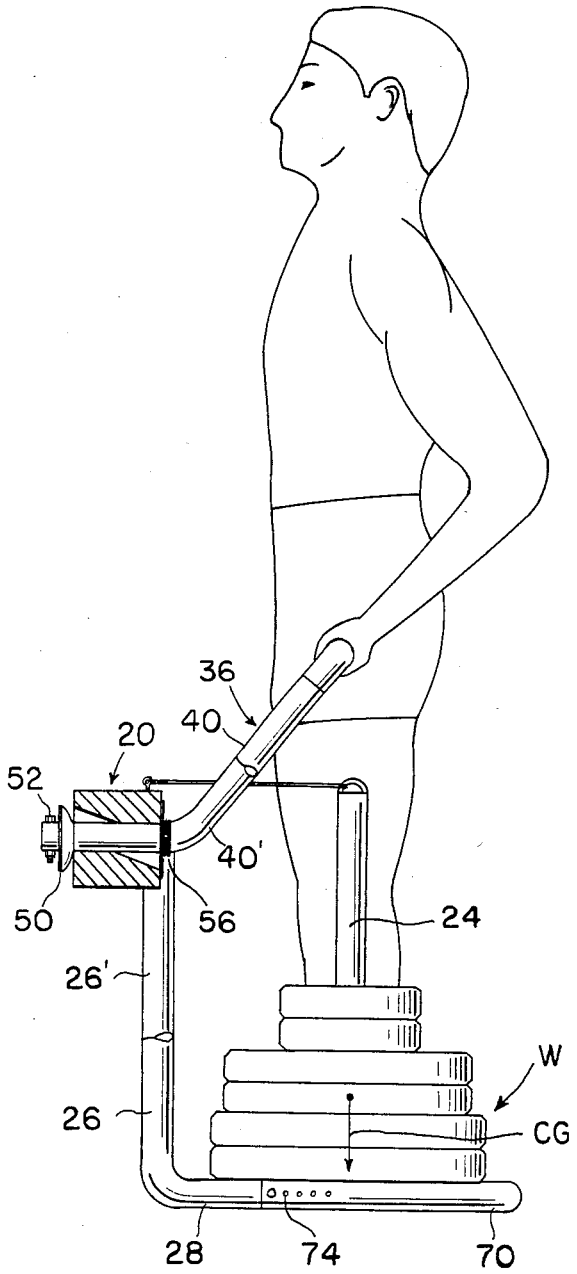
FIGS. 2 and 3 are side views of the weight bar assembly of FIG. 1 as it is used during curling exercises.

FIG. 1 illustrates a weight bar assembly including a main lift bar 20 with a U-shaped weight supporting element 22 or 22′ secured at each end thereof. Main bar 20 may be cylindrical or of a square configuration as shown, or of any other configuration. The U-shaped weight supporting elements each include a vertical weight stacking bar 24 or 24′, upon which a variable number of weights are vertically loaded and supported, and a vertical connection bar 26 or 26′ forming a spacing bar which is affixed to the main bar 20. Vertical connection bars 26, 26′ support main bar 20 vertically above the ground at all times. Bars 24, 26 and 24′, 26′ are connected at their lower ends by horizontally extending bar 28 or 28′ which laterally displace the center of gravity (CG) of weights (W) to one side of main bar 20 as shown in FIG. 2.

Vertical connection bars 26 and 26′ extend upwardly from bars 28 and 28′ and terminate in L-shaped ends by which the bars 26, 26′ are affixed to main bar 20. One of the L-shaped ends is designated by the numeral 30 in FIG. 3. Each L-shaped end is passed through main bar 20 until vertical connection bars 26 and 26′ seat in recesses 32 and 32′ in main bar 20. The main bar is secured to the L-shaped ends by a retention assembly 34 which may be, for example, a nut and bolt and bumper washer type retention assembly. It should be noted that the U-shaped supporting elements 22, 22′ could be secured to main bar 20 in any other desired manner or could even be integrally formed therewith. Support cables or chains 35, 35′ are provided which extend between and are attached to, in any appropriate manner, main bar 20 and the upper ends of vertical weight stacking bars 24, 24′. Such support cables or chains prevent bars 24, 24′ from bending away from main bar 20 when the loaded weight bar assembly is lifted off the ground.

Connected to main bar 20 and disposed centrally of the U-shaped weight supporting elements 22 and 22′ is a pair of handles 36, 36′. Each handle includes a gripping portion 38, 38′ and angular shaft 40, 40′, displaced laterally on the same side of main bar 20 as the center of gravity of weights W. One end of each angular shaft 40, 40′ is secured to the respective gripping portion in any conventional manner. The opposite end of each angular shaft is received in one of a series of rounded slots 42*a–e*, 42′*a–e* formed in openings 42, 42′ in the main bar.

As may be seen from FIGS. 6–9, the series of rounded slots 42*a–e*, 42′*a–e* allow handles 36, 36′ to be moved from side to side such that they may be located at any one of a variety of distances apart from one another. In the embodiment illustrated in FIGS. 1–13, these distances range between 16″ and 24″. Angular shafts 40, 40′ are each pivotal within a respective rounded slot between lifts so as to allow gripping portions 38, 38′ to accommodate a wrist angle which is most comfortable to the lifter for a particular type of lift.

Each angular shaft 40 and 40′ is connected to main bar 20 in an identical manner. For simplicity, only the connection between angular shaft 40 and main bar 20 will now be described, it being understand that the connection between the other angular shaft 40′ and the main bar 20 is the same.

Figure 10:
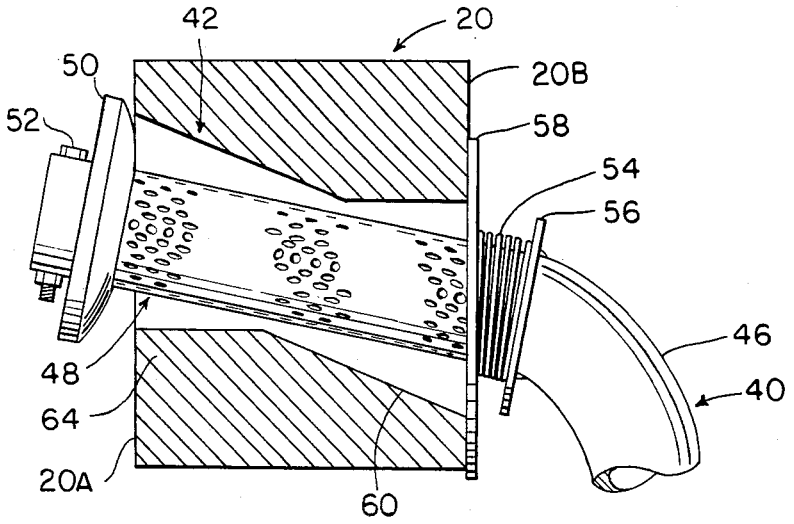
FIGS. 10–12 illustrate the connection between the handle shafts and the main bar of the assembly of FIG. 1.
Figure 11:
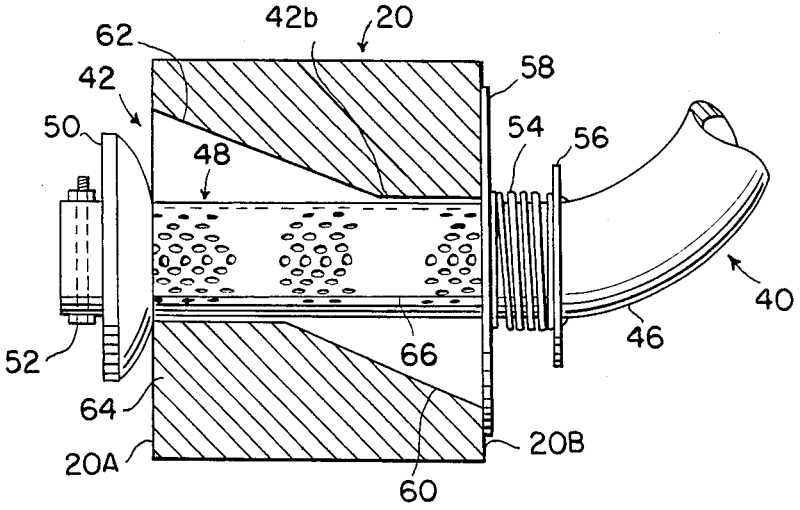
Figure 12:
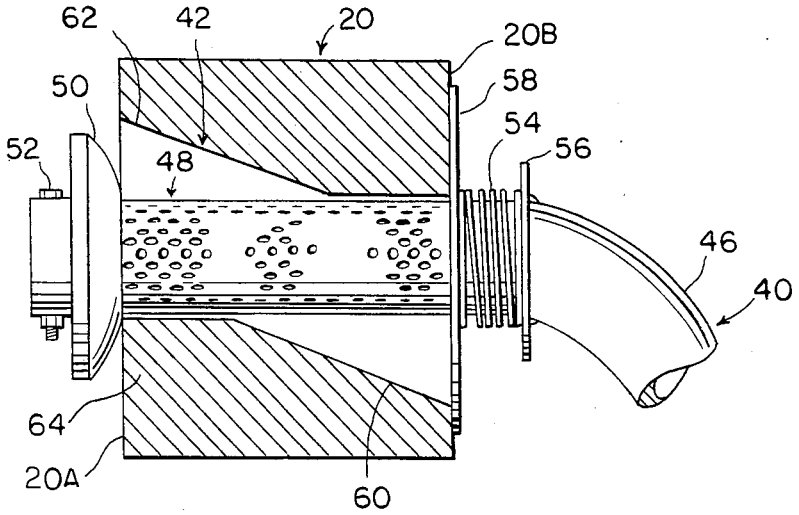

Referring now to FIGS. 10–12, angular shaft 40 may be seen to include an elbow 46 at one end of a portion 48 extending through the opening 42 in main bar 20. As illustrated in FIGS. 7, 11 and 12, portion 48 is located in rounded slot 42*b*. Received about the end of portion 48 opposite elbow 46 is a bumper washer 50. Bumper washer 50 is formed with a central aperture therein (not shown) through which an end of portion 48 extends. The bumper washer is retained on portion 48, in abutment with surface 20A of main bar 20, by a nut and bolt retention assembly 52.

A spring 54 is disposed between a first washer 56 and a second washer 58. First washer 56 is fixedly secured by a weld to shaft 40 adjacent elbow 46, while second washer 58 is forced toward surface 20B of main bar 20 under the bias of spring 54. Opening 42 includes planar, inclined surfaces 60 and 62 which extend parallel to each other, and planar surface 64 and surface 63 of arcuate slot 42b, which extend parallel to each other and transverse to surfaces 60 and 62. Portion 48 is usually urged by the force of spring 54 on second washer 58 into engagement with surface 64 and a surface 63 of one of the slots 42*a–e*.

The weight lifter may change the distance between the handles 36, 36′ if he or she wishes. Portion 48 of handle 36 is originally located in one of the rounded slots, for instance slot 42*b* as shown in FIG. 7. To move portion 48 from rounded slot 42*b* to another rounded slot, the lifter simply presses gripping portion 38 downwardly, against the force of spring 54, so that portion 48 is moved out of rounded slot 42*b* and toward flat, inclined surfaces 60 and 62. Portion 48 is the slid to either side until the portion is in alignment with the new rounded slot in which it is to be located. Gripping portion 38 may then be released. Under the action of spring 54, portion 48 will be moved into engagement with the surface 63 of the rounded slot selected and the surface 64. Spring 54 will subsequently maintain portion 48 in engagement with surface 64 and within the rounded slot until the lifter is once again ready to change the location of gripping portion 38. Portion 48 may be provided about its circumference with a pleated or grooved elastomeric material 66 as shown in FIGS. 10–12 to improve the frictional contact between portion 48 and the opening 42 to aid in keeping handles 36, 36′ at a fixed angular position during a lift. It should be clear that the location of gripping portion 38′ may be changed in an identical fashion.

Angular shafts 40, 40′ are movable so as to allow handles 36, 36′ to be oriented in a setting above or below main bar 20. FIGS. 2, 3, 8 and 9 illustrate the handles in their upper setting, while FIGS. 4, 5, 6 and 7 illustrate the handles in their lower setting. The upper setting of handles 36, 36′ allows the hands of a weight lifter to be close to his or her body for curls or for clean and press exercises. If, on the other hand, the weight bar assembly is to be used for bench press type exercises, handles 36, 36′ are moved to the lower setting illustrated in FIGS. 4, 5, 6 and 7. Angular shafts 40, 40′ are movable between lifts in either a clockwise or counterclockwise direction, viewing FIGS. 6–9, so that they are able to occupy an angular position which is comfortable for any particular weight lifter.

Figure 13A:
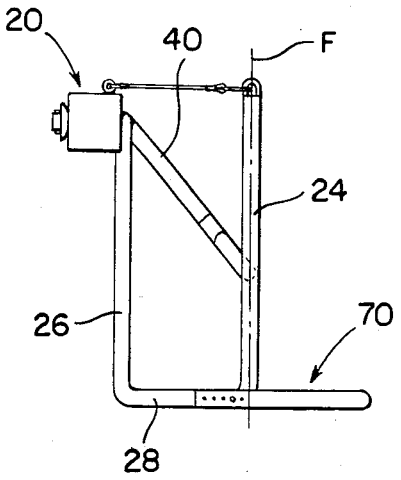
FIGS. 13A and 13B show the handle gripping portions and the weight stacking bars of FIG. 1 as lying in a single plane.
Figure 13B:
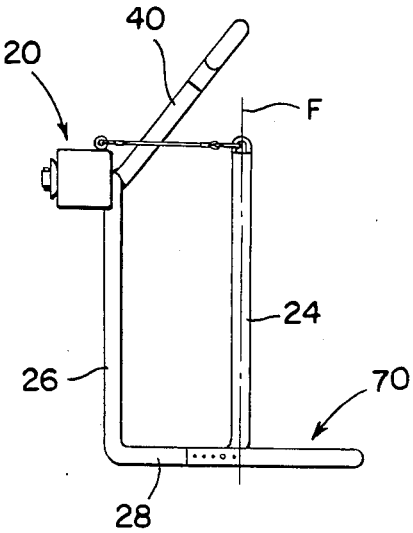

The weight bar assembly is constructed such that gripping portions 38, 38′ and the weights W are all disposed on one side of main bar 20 during a lift. As the drawing figures, and in particular FIGS. 13A and 13B, illustrate, gripping portions 38, 38′ and vertical weight stacking bars 24 and 24' all lie in a single plane, designated F in FIG. 13, in both the upper and lower settings of handles 36, 36'.

Since main bar 20, connection bars 26, 26' and angular shafts 40, 40' are all disposed on one side of plane F, the weight bar assembly will tend to rotate about gripping portions 38, 38' in a counterclockwise direction, as seen in FIGS. 2–5 and 13, unless compensation is made for the weight of the main bar, the connection bars and the angular shafts. For this purpose, adjustable counterbalances 70 and 70' are respectively attached to horizontally extending bars 28 and 28' to extend horizontally past vertical weight stacking bars 24, 24' in a direction away from main bar 20. Proper adjustment of counterbalances 70 and 70' in a manner to be described presently will distribute equally the weight of the entire weight bar assembly on each lateral side of a line of balance L of the weight bar assembly which passes through gripping portions 38, 38' as illustrated in FIG. 1. In FIGS. 1–13, the line of balance L will at all times lie in the plane F.

Counterbalances 70, 70' each include two legs 72, 72 or 72', 72' between which one of the horizontally extending bars 28 or 28' is placed. Each counterbalance leg has a series of holes 74 therein, one of which is aligned with a corresponding hole (not shown) in horizontally extending bars 28, 28' and through which a screw or other fastener is placed.

Counterbalances 70, 70' may be adjusted, by selection of the appropriate hole 74, to counterbalance the weight of the main bar 20, angular shafts 40, 40' and portions of the U-shaped weight supporting elements 22, 22' which are disposed on the one side of the plane F. Vertical weight stacking bars 24, 24' therefore remain perpendicular to the floor at all times during a lift. The counterbalances also provide a larger, more stable base for the weight bar assembly. Since gripping portion 38, 38' and vertical weight stacking bars 24, 24' lie in the same plane F, once the counterbalances are adjusted such that bars 24, 24' are perpendicular to the ground or floor, no further adjustment is necessary, regardless of how much weight is put on the bar.

Figure 3:
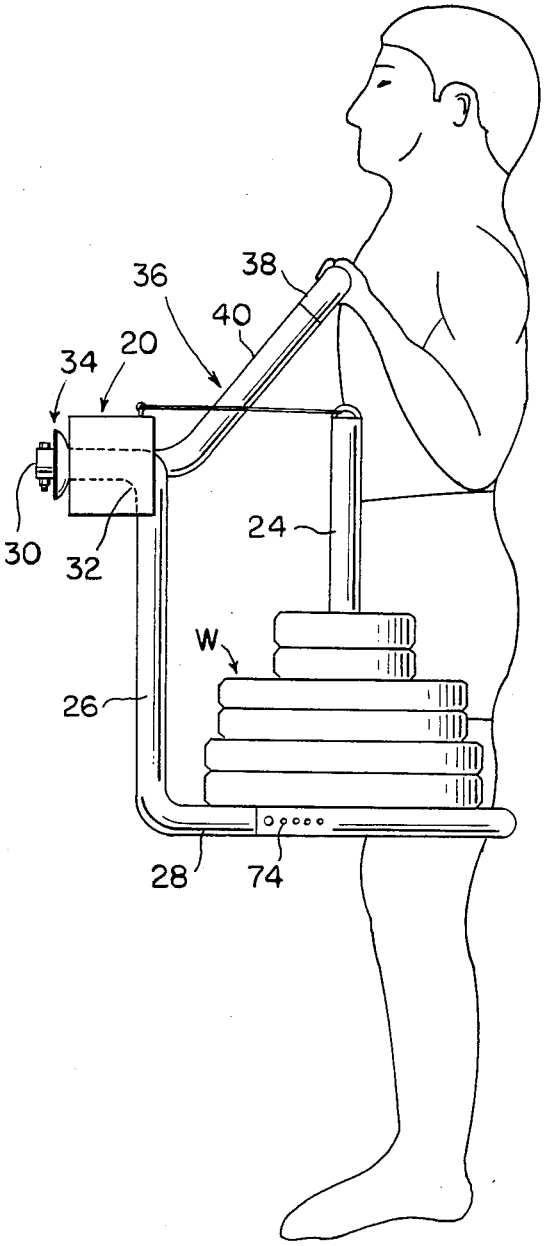

The weight bar assembly as it is used in curling exercises is illustrated in FIGS. 2 and 3. Handles 36, 36' are in their upper setting. Horizontally extending bars 28, 28' are initially in contact with the floor, as seen in FIG. 2. The upper setting of handles 36, 36' allows gripping portions 38, 38' to be close to the upper body of the weight lifter. Having the gripping portions close to the weight lifter's upper body reduces unnecessary back strain which may occur as the lifter leans over to pick up a conventional weight bar. In addition, since the weight lifter is able to stand between gripping portions 38, 38', his or her body can be aligned in a normal stance directly between each stack of weights W, thereby further reducing unnecessary back strain. Conventional weight bar assemblies do not allow such alignment due to the bar which extends between the gripping portions thereof.

Figure 4:
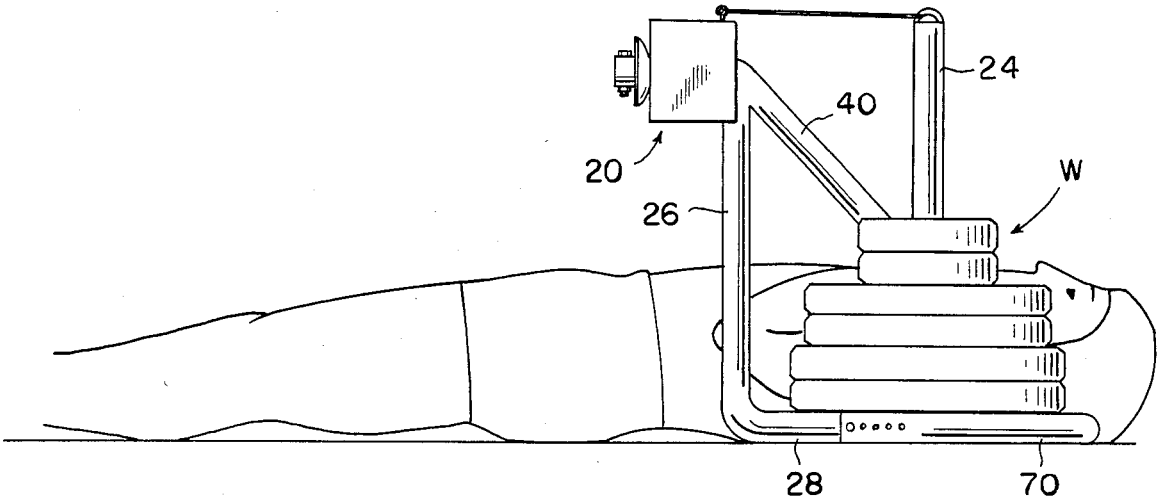
FIGS. 4 and 5 are side views of the weight bar assembly of FIG. 1 as it is used during pressing exercises.
Figure 5:
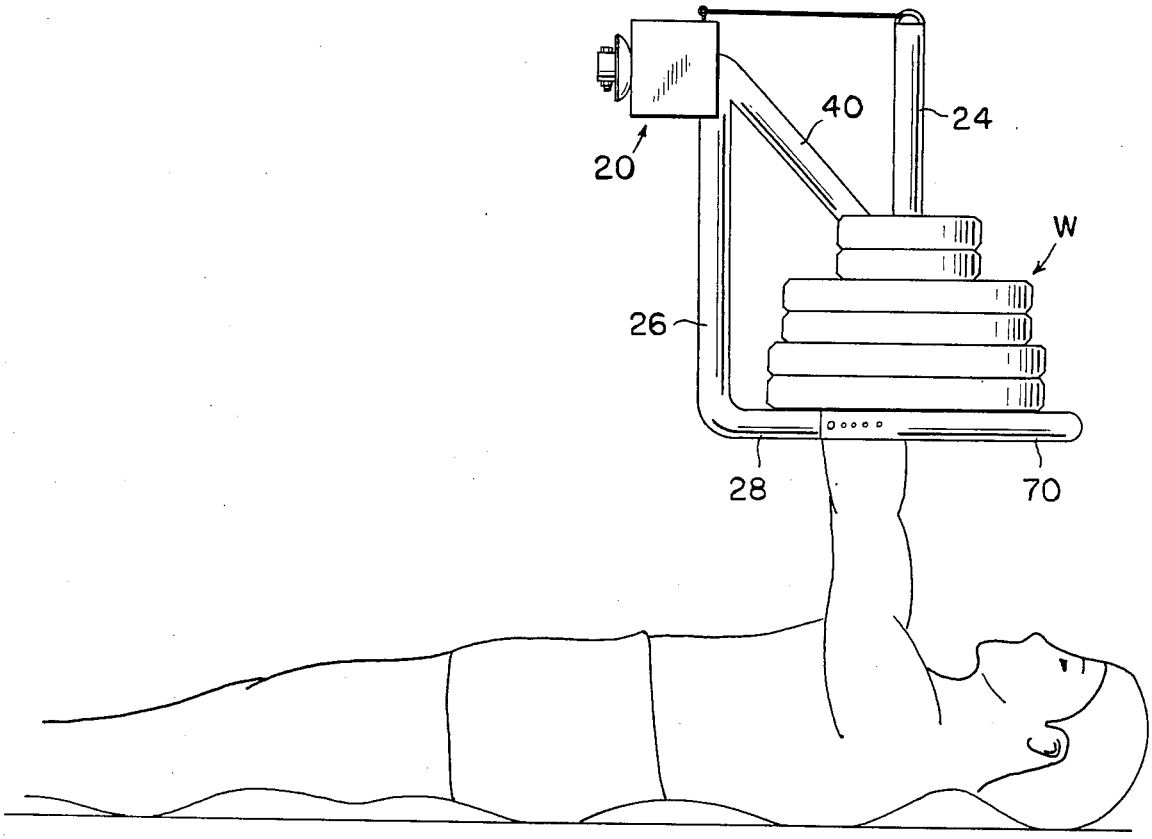

The weight bar assembly as it is used in pressing exercises is illustrated in FIGS. 4 and 5. Handles 36, 36' are in their lower setting. Horizontally extending bars 28, 28' are initially in contact with the floor. When the handles 36, 36' are in the lower setting, gripping portions 38, 38' are located below main bar 20 such that bench press type exercises can be performed without actually needing a bench. A weight lifter can simply slide under main bar 20 which is supported via elements 22 and 22' vertically above the floor. Further, since main bar 20 is at all times supported vertically above and laterally away from both gripping portions 38, 38' and the weight lifter's body by vertical connection bars 26, 26', main bar 20 will be unable to choke or injure the weight lifter should he or she become unable to lift the weight bar assembly. The weights W will come to a stop on the floor before main bar 20 is able to put any pressure on the weight lifter's body.

FIGS. 14–16 illustrate a modified form of the weight bar assembly of FIGS. 1–13. The assembly illustrated in FIGS. 14–16 includes main lift bar 120 with a U-shaped weight supporting element 122 or 122' at each end thereof. The supporting elements in this embodiment include vertical weight stacking bars 124, 124', upon which a variable number of weights are vertically stacked and supported in a manner similar to that described in connection with the embodiment illustrated in FIGS. 1–13, and bars 128, 128', which laterally displace the center of gravity of weights (not shown) mounted on weight stacking bars 124, 124' to one side of main bar 120. Also illustrated in FIGS. 14–16 are support cables or chains 135, 135', and a pair of handles 136, 136'. Handles 136, 136' are connected to main bar 120 and disposed centrally of elements 122 and 122'. Support cables or chains 135, 135' function identically to the support cables or chains illustrated in FIGS. 1–13. The construction of handle 136 will now be described, it being understood that handle 136' is in all respects identical to handle 136.

A gripping portion 138 is attached to one end of angular shaft 140 of handle 136. As shown in FIGS. 14 and 16, gripping portion 138 is displaced laterally from main bar 120 on the same side of the main bar as the center of gravity. At the end of shaft 140 opposite gripping portion 138 are disposed a bumper washer 150 and bolt retaining means 152. It should be clear from the above and from FIGS. 14 and 16 that handles 136, 136' are identical to handles 36, 36' described in connection with the embodiment of FIGS. 1–13.

Handles 136, 136' are adjustable along bar 120 so that the weight lifter may change the distance between the handles if he or she wishes. In this embodiment, angular shaft 140 is received in a single oblong slot 142 which is in FIG. 15. The oblong slot 142 includes smooth inclined surfaces 160, 162 which extend parallel to each other and smooth horizontal surfaces 163 and 164 which extend parallel to each other and transverse to surfaces 160, 162. These surfaces cooperate with shaft 140 similarly to the manner in which surfaces 60, 62, 64 cooperate with shaft 40 in the embodiment of FIGS. 1–13. The oblong slot 142 is formed in block 144 which is welded or otherwise affixed within openings formed in the lower portion of each of two block receiving plates 146 and 148. Each plate 146, 148 includes a part circular deformation in the central portion thereof which passes about the exterior of main bar 120.

A knob bolt 174 including threaded shaft 176 is passed through a hole in the upper portion 178 of plate 146. The threaded shaft is screwed into and passes through a threaded portion 180 affixed on upper portion 182 of plate 148.

Main bar 120 has welded or otherwise affixed along the top thereof a slide stop 184. Upper portion 178 is located on one side of the slide stop, while upper portion 182 is located on the other side thereof. As knob bolt 174 is tightened, upper portions 178 and 182 are drawn together, causing plates 146 and 148 to clamp against bar 120 and slide stop 184 tightly. Slide stop 184 will cooperate with plates 146 and 148 to prevent handle 136 or 136' from rotating about main bar 120 should knob bolt 174 inadvertently become loose.

The distance between handles 136, 136' may be changed by first loosening knob bolt 174. Loosening knob bolt 174 allows plates 146 and 148 to separate. The plates may then be slid along main bar 120, carrying handle 136 and 136' to a new location. Knob bolt 174 is subsequently tightened to fix handle 136 or 136' in its new location.

Each of the U-shaped supporting elements 122, 122' include vertical connection bars 187, 187' comprising sleeve portions 188, 188' and rod portions 190, 190'. The vertical connection bars form spacers affixed to main bar 120 supporting the main bar vertically above the ground at all times. Each rod portion has a series of holes 192, 192' therein which is aligned with a corresponding hole in the associated sleeve portion. A pin or other fastener 194 is placed through the aligned holes. By changing the hole 192 through which fastener 194 extends, the distance at which main bar 120 is supported above the floor or ground can be adjusted.

In the embodiment of FIGS. 14–16, an alternative construction for keeping the vertical weight stacking bars 124, 124' perpendicular to the ground is also provided. In this construction, the need for separate counterbalances is eliminated. Sleeve portions 188, 188' each include a series of holes 196, 196' which allow U-shaped supporting elements 122, 122' to rotate toward or away from main bar 120. By placing fasteners 194, 194' respectively through appropriate holes 196, 196', the angular position of the supporting elements may be variably selected. The center of gravity of the weights stacked on bars 124, 124' can thus be moved laterally so as to locate the line of balance (not indicated in FIGS. 14–16) of the weight bar assembly at gripping portions 138. The weights stacked on bars 124, 124' will thus counterbalance the weight of the main bar and of that part of handles 136, 136' located on the side of gripping portions 138, 138' opposite stacking bars 124, 124'. It should be noted that in this embodiment, gripping portions 138, 138' do not lie in a single vertical plane with vertical stacking bars 124, 124'. Vertical stacking bars 124, 124' are kept perpendicular to the floor at all times during a lift simply by selecting the appropriate angular position of supporting elements 122, 122' without any need for the additional counterbalances described in conjunction with the embodiment of FIGS. 1–13.

FIGS. 17–19 illustrate another modified form of the weight bar assembly. Included in this embodiment is a main lift bar 220 which again is at all times supported above and horizontally away from the weight lifter's body during press type exercises. At each end of main bar 220 is disposed a weight formed by a plastic container 222 or 222' which is filled with sand, water or other material via fill spouts 224, 224' and which are retained on bar 220 in any appropriate manner. Containers 222, 222' could be integrally formed with bar 220 if so desired. Handles 226, 226' are formed on top of each container for easy carrying.

Each plastic container is formed with a pair of vertical slots through which one end portion of main bar 220 extends. The vertical slots may be lined with appropriate sealing devices 228 if necessary. The vertical slots are formed closer to one side of the containers 222, 222' than to the other, as FIGS. 17–19 illustrate, such that the center of gravity CG of the weights is laterally displaced to one side of main bar 220.

The weight bar assembly illustrated in FIGS. 17–19 includes a construction by which a pair handles 236, 236' are connected to main bar 220. Handles 236, 236' are connected to main bar 220 and disposed centrally of containers 222, 222'. Each handle 236, 236' respectively has a gripping portion 237, 237' displaced laterally from main bar 220 and an externally threaded handle shaft 238, 238' which is received within one of a pair of tubular, internally threaded handle shaft locaters 240, 240' or 242, 242'. The handle shaft locaters are integrally formed with or affixed within main bar 220 in any appropriate manner.

Handles 236, 236' may be located in two different angular positions with respect to one another, depending on which pair of tubular, internally threaded handle shaft locaters the threaded handle shafts are received within. As FIG. 18 illustrates, when handle shafts 238, 238' are received in shaft locaters 240 and 240', the handle shafts extend outwardly in a direction perpendicular to main bar 220. On the other hand, as FIG. 19 illustrates, when handle shafts 238, 238' are received in shaft locaters 242, 242' the handle shafts extend outwardly at an acute angle with respect to main bar 220. Different wrist orientations may therefore be accommodated.

Since the handle shafts 238, 238' are each threaded and received within a correspondingly threaded handle shaft locator, rotation of the handle shafts will cause handles 236, 236' to be moved inwardly or outwardly relative to main bar 220. Gripping portions 237, 237' may thus be moved toward or away from main bar 220 as needed in order to cause the line of balance L to pass through the gripping portions so as to balance the weights and keep the underside of containers 222 and 222' parallel to the floor.

Figure 20:
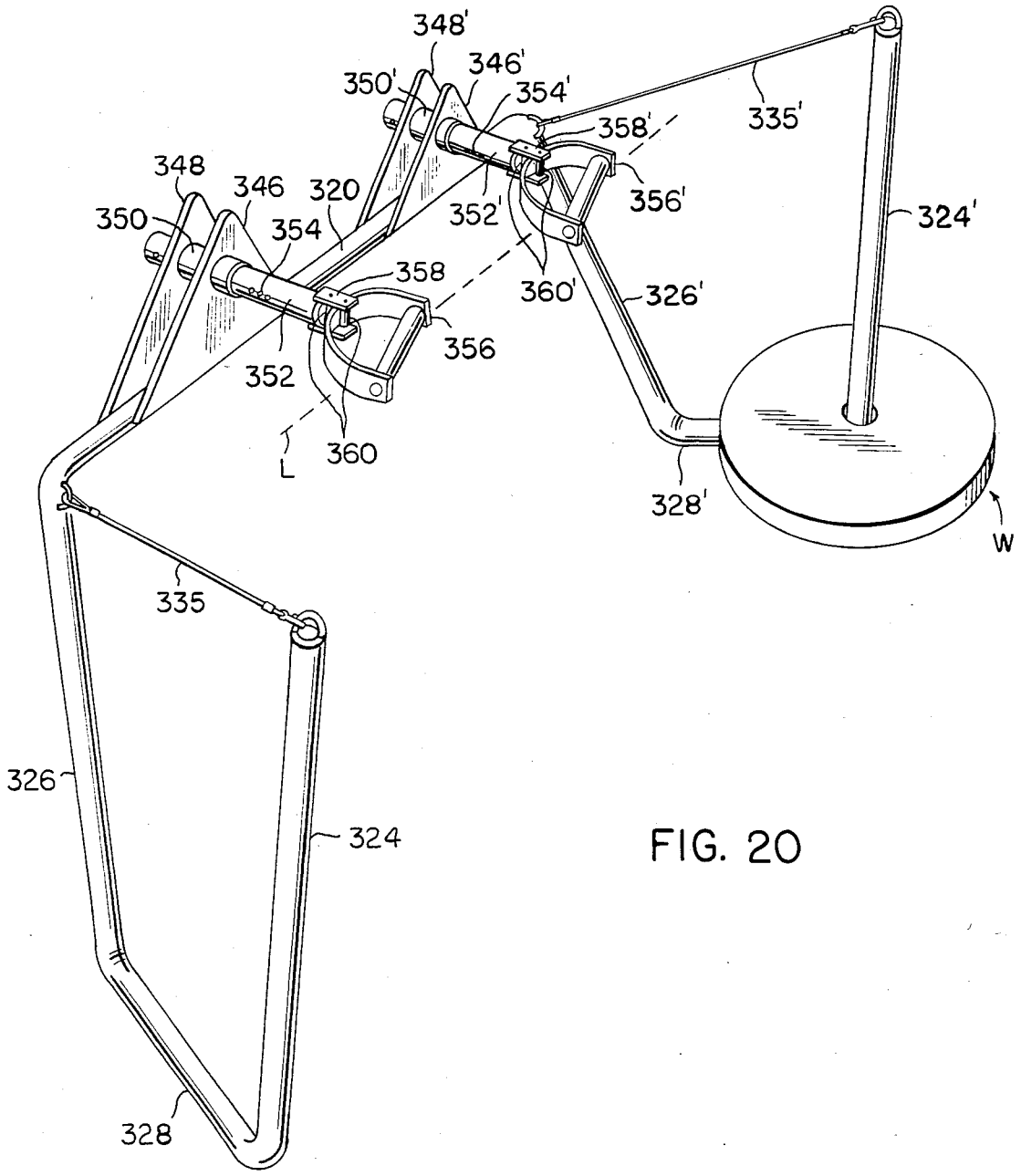
FIG. 20 shows a bar assembly including pivotable and swivelable gripping portions.

FIG. 20 illustrates another embodiment of the invention. Shown in FIG. 20 is a main lift bar 320 integrally formed with weight supporting elements at each end thereof. The weight supporting elements include vertical connection bars 326, 326', horizontally extending bars 328, 328' and vertical weight stacking bars 324, 324'. Horizontally extending bars 328, 328' laterally displace the center of gravity of weights supported on bars 324, 324' to one side of main bar 320. Also illustrated in FIG. 20 are support cables or chains 335, 335' which function similarly to previously described support cables or chains 35 and 35'.

Main bar 320 has affixed thereto shaft locaters 346, 348 and 346', 348'. Welded or otherwise secured within apertures formed in these plates are sleeves 350 and 350'. A pair of handles are connected to main bar 320 and disposed centrally of the weight supporting elements. Handle shafts 352, 352' displace gripping portions 356, 356' laterally from main bar 320. Handle shafts 352, 352' are rotatable in but axially retained within sleeves 350 and 350', respectively, by screws or pins disposed on either side of sleeves 350 in appropriate holes 354, 354' formed in the handle shafts. By the selection of the appropriate holes 354, 354', gripping portions 356, 356 can be moved toward or away from main bar 320 as needed in order to cause the line of balance L to pass through the gripping portions so as to balance the weights and keep bars 328, 328' parallel to the ground or floor.

Gripping portions 356, 356' are respectively connected to ends of handle shafts 352, 352' by brackets 358, 358' secured to the handle shafts and within which rollers 360, 360' are mounted. Gripping portions 356, 356' are thus rendered pivotable, so that the angular orientation of the gripping portions relative to main bar 320 can be adjusted, and swivelable by the cooperation between the handle shafts and sleeves 350, 350'. The pivoting and rotating gripping portions 356, 356' thereby allow the wrists of a weight lifter to assume their most natural lifting angle throughout a particular lift. A weight lifter may even continue a curl directly through in one motion into an overhead press without loosening his or her grip on the gripping portions.

Figure 21:
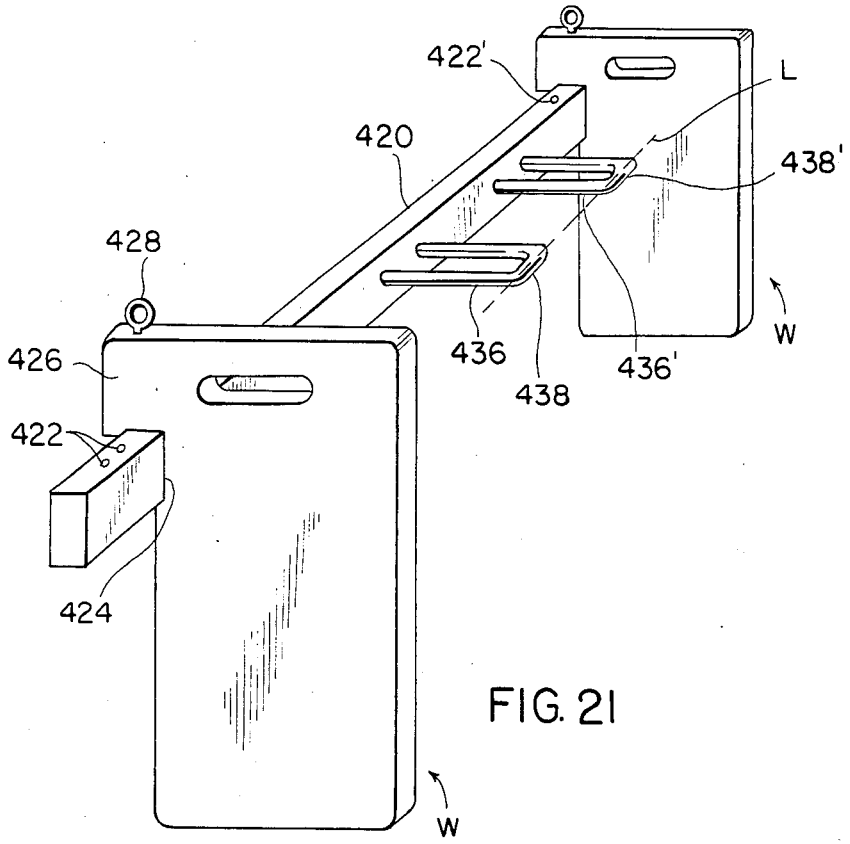
FIG. 21 illustrates a weight bar assembly in which the weights are directly connected to the main bar.

FIGS. 21–25 illustrate another modified form of the invention which enables a weight lifter to add or take away weight from the main bar easily and efficiently. A main lift bar has mounted in the central portion thereof a pair of U-shaped, offset handles 436, 436', the gripping portions of which are displaced laterally from main bar 420. At each outer end of main bar 420 is provided a series of holes 422, 422'. Each end of the main bar supports a variable number of weights W. In this embodiment, weights W themselves form the spacing means to support main bar 420 vertically with respect to the ground. Each weight includes a recess 424 formed therein below a flange 426 and within which main bar 420 is received. The weights each include a hole passing vertically through flange 426. This hole is aligned with one of the series of holes 422 or 422' such that a pin or other fastener 428 passes through the aligned holes to lock the weight W to the main bar 420. FIG. 21 illustrates one weight W mounted at each end of the main bar 420. If a weight lifter wishes to add more weights to the main bar, additional weights W may be locked to the main bar 420 by utilizing additional holes 422, 422'. The weight supporting elements in this embodiment are therefore formed by the axially outer ends of main bar 420 themselves.

Figure 25:
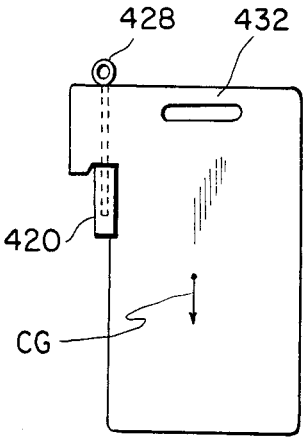
FIGS. 22–25 show the manner in which the weights of FIG. 21 are mounted on the main bar.
Figure 24:
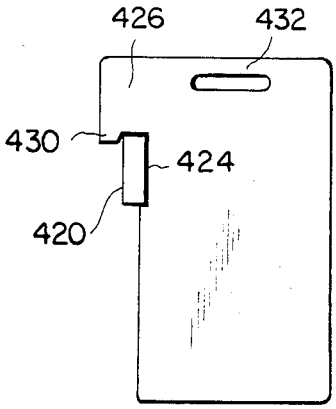
Figure 22:
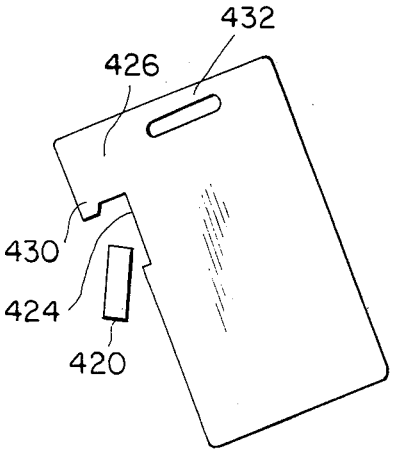
Figure 23:
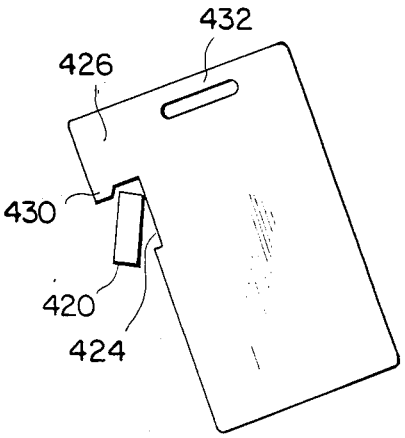

FIGS. 22–25 show the manner in which weights W are mounted to the main bar. The weights are initially positioned as illustrated in FIG. 22, with flange 426 overlying the top of main bar 420. The weights are then moved into the position illustrated in FIG. 23, with lip portion 430 of flange 426 contacting a side of main bar 420. The weight is then rotated into the position illustrated in FIG. 24, with flange 426 and lip portion 430 positioning the weight such that main bar 420 is automatically aligned with recess 424. Finally, as FIG. 25 illustrates, a pin 428 is passed through the hole in flange 426 and the corresponding aligned hole 422 and 422' in the main bar to lock the weight and main bar together. The removal of weights is accomplished by reversing the steps outlined above. Each weight W includes a handle 432 formed in the top portion thereof to make lifting a weight W on or off the main bar easy. As FIG. 25 illustrates, the center of gravity CG of weights W is laterally displaced to one side of main bar 420 by virtue of the location of flange 426.

Handles 436, 436' extend horizontally outwardly from main bar 420. The handles are dimensioned such that the line of balance L of the weight bar assembly passes through gripping portions 438, 438' thereof. The undersides of weights W are thereby kept parallel to the floor throughout lifting of the weight bar assembly.

FIG. 26 illustrates yet another modified form of the invention. Shown in FIG. 26 is a main lift bar 20 identical to that described in connection with FIGS. 1—13 above. Disposed on each vertical weight stacking bar 24, 24' of main bar 20 are containers 502. Only one container 502 is illustrated in FIG. 26. It should be understood, however, that a container 502 is disposed on each vertical weight stacking bar 24, 24'. Containers 502 are each formed of a portion 503 of hose or tubing 504 wrapped or formed to fit around vertical weight stacking bar 24 and at least partially filled with liquid. In order to maintain portion 503 in its wrapped configuration, each coil or spiral of portion 503 may be bonded, tied or otherwise affixed to each adjacent coil or spiral. A pressurized, inflatable air containing balloon 506 is located at a first end of hose 504. Balloon 506 contains air which flows out of or into each portion 503. This air flow will occur as water or other liquid is forced into or allowed to flow out of each portion 503 in a manner to be described presently, thereby displacing the air originally contained in portion 503. A second end of hose 504 opposite the first end is connected in any conventional manner to an accordian shaped, liquid containing, flexible storage tank 508. The force of the air pressure from air contained in balloon 506 overcomes the force of gravity acting on the liquid combined in tank 508, thereby preventing undesirable liquid flow from the tank. A single storage tank 508 may be used to supply liquid to both containers 502. Alternatively, a separate storage tank 508 may be used in connection with each container 502.

Storage tank 508 is contained within a U-shaped frame 510 including legs 511. As FIG. 27 illustrates, tank 508 has formed in the underside thereof a tunnel 512 to receive a portion of frame 510 which passes therethrough. Frame 510 includes a series of parallel grooves 514 on each leg 511. The grooves receive a steel rod 516. Rod 516, which may be made of steel, is also passed through a bore 518 formed in handle 520. Handle 520 is mounted on tank 508 such that it may swivel on the tank so as to align bore 518 with grooves 514 and the rod 516.

Viewing FIG. 26, in order to select the amount of weight to be lifted, a weight lifter first withdraws rod 516 from parallel grooves 514 and bore 518. By grasping handle 520, the weight lifter may then push downwardly on flexible storage tank 508 to compress the tank. This causes a decrease in the internal volume of tank 508, and the liquid contained in the tank is forced through hose 504 into portions 503. As FIG. 26 shows, the U-shaped frame 510 preferably includes indicia thereon to aid the weight lifter in selecting the desired weight to be lifted.

After handle 520 has been depressed a distance sufficient to force the desired amount of liquid into portions 503, bore 518 is aligned with a groove 514 on each of frame legs 511. Rod 516 is then reinserted in the grooves and through the bore. Rod 516 thus retains tank 508 in its compressed condition, and the desired amount of liquid is retained in portions 503. The weight of the liquid retained in portions 503 provides the amount of weight to be lifted.

The foregoing is considered as illustrative only of the principles of the invention. Since numerous modifications and changes will readily occur to those skilled in the art, it is not desired to limit the invention to the exact constructions and operations shown and described. Accordingly, all suitable modifications and equivalents falling within the scope of the invention defined by the following claims may be resorted to.

What is claimed is:

1. A weight bar assembly comprising:

a main bar having a pair of ends;

a weight supporting element located at each end of said main bar, said weight supporting elements supporting a variable number of weights having a center of gravity laterally displaced to one side of said main bar when said weights are mounted on said weight supporting elements, said weight supporting elements including spacing means affixed to said main bar and supporting said main bar at a distance vertically above ground; and handles connected to said main bar and disposed centrally of said weight supporting elements, each handle including a gripping portion laterally displaced to said one side of said main bar and an angular shaft secured at one end to said gripping portion, said angular shaft being received in a slot formed in said main bar, each said angular shaft being movable to allow each handle to be oriented in a first position located above said main bar and a second located below said main bar.

2. A weight bar assembly as defined by claim 1, wherein adjustable counterbalances are respectively attached to each weight supporting element to distribute equally the weight of the entire weight bar assembly on each lateral side of a line of balance which passes through said gripping portions.

3. A weight bar assembly as defined by claim 1, wherein said slot is one of a series of rounded slots formed in openings in said main bar, said series of rounded slots allowing said handles to be moved such that the handles may be located at any one of a variety of distances apart from one another.

4. A weight bar assembly as defined by claim 1, wherein said spacing means comprises means for adjusting said distance vertically above the ground of said main bar.

5. A weight bar assembly as defined by claim 4, wherein said spacing means further comprises means for laterally moving said center of gravity of said weights to distribute equally the weight of the entire weight bar assembly on each lateral side of a line of balance which passes through said gripping portions.

6. A weight bar assembly as defined by claim 1, wherein each said weight supporting element is U-shaped and includes a vertical weight stacking bar for vertically loading a variable number of weights, a horizontally extending bar connecting a lower end of said vertical weight stacking bar to a lower end of a vertical connection bar, said vertical connection bar forming said spacing means.

7. A weight bar assembly comprising:

a main bar having a pair of ends;

a weight supporting element located at each end of said main bar, said weight supporting elements supporting a variable number of weights having a center of gravity laterally displaced to one side of said main bar when said weights are mounted on said weight supporting elements, said weight supporting elements including spacing means affixed to said main bar and supporting said main bar at a distance vertically above ground; and handles connected to said main bar and disposed centrally of said weight supporting elements, each handle including a gripping portion laterally displaced to said one side of said main bar and an angular shaft secured at one end to said gripping portion, said angular shaft being received in a slot formed in a block connected to said main bar, each said angular shaft being movable to allow each handle to be oriented in a first position located above said main bar and a second located below said main bar.

8. A weight bar assembly as defined by claim 7, wherein said slot is an oblong slot and said block is affixed within openings in each of two block receiving plates, said plates slidable along said main bar such that the handles may be located at any one of a variety of distances apart from one another.

* * * * *